US008552824B1

(12) United States Patent
Pal

(10) Patent No.: US 8,552,824 B1
(45) Date of Patent: Oct. 8, 2013

(54) INTEGRATED PLANAR ELECTROMECHANICAL CONTACTORS

(75) Inventor: Debabrata Pal, Hoffman Estates, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 0 days.

(21) Appl. No.: 13/438,328

(22) Filed: Apr. 3, 2012

(51) Int. Cl.
*H01H 3/00* (2006.01)

(52) U.S. Cl.
USPC ..... 335/185; 335/78

(58) Field of Classification Search
USPC ..... 335/78, 83, 124, 128, 185; 200/181
See application file for complete search history.

(56) References Cited

U.S. PATENT DOCUMENTS

| | | | | |
|---|---|---|---|---|
| 3,490,056 | A | 1/1970 | Warren et al. | |
| 4,053,857 | A | 10/1977 | Guraydin | |
| 4,410,251 | A | 10/1983 | Lee | |
| 6,084,281 | A * | 7/2000 | Fullin et al. | 257/422 |
| 6,310,526 | B1 * | 10/2001 | Yip et al. | 333/262 |
| 6,411,184 | B1 | 6/2002 | Comtois et al. | |
| 6,800,912 | B2 | 10/2004 | Ozgur | |
| 7,220,131 | B1 | 5/2007 | Pecht et al. | |
| 7,274,064 | B2 | 9/2007 | Bertin et al. | |
| 7,943,464 | B2 | 5/2011 | Berg et al. | |
| 2002/0158729 | A1 | 10/2002 | Allada et al. | |
| 2003/0151480 | A1 * | 8/2003 | Orr | 335/78 |
| 2004/0214367 | A1 | 10/2004 | Segal et al. | |
| 2005/0047010 | A1 * | 3/2005 | Ishiwata et al. | 360/123 |
| 2009/0256217 | A1 | 10/2009 | Lu et al. | |
| 2011/0188174 | A1 | 8/2011 | Simper et al. | |

FOREIGN PATENT DOCUMENTS

EP 2164088 A1 * 3/2010

* cited by examiner

*Primary Examiner* — Bernard Rojas
(74) *Attorney, Agent, or Firm* — Cantor Colburn LLP

(57) ABSTRACT

An integrated planar electromechanical contactor assembly includes a substrate, a through-hole formed through the substrate, a plurality of solenoid traces embedded within the substrate about the through-hole in a plurality of distinct planes, a solenoid core arranged in the through hole in electromagnetic communication with the plurality of solenoid traces, and a mobile contact arm. The plurality of distinct planes are substantially parallel to one another and each solenoid trace of the plurality of solenoid traces is in electrical communication with an adjacent solenoid trace through an electrical via. Furthermore, the mobile contact arm is configured to selectively connect an external contact lead arranged on the substrate to at least one electrical trace embedded within the substrate responsive to motion of the solenoid core.

17 Claims, 5 Drawing Sheets

INTEGRATED PLANAR ELECTROMECHANICAL CONTACTORS

BACKGROUND OF THE INVENTION

Generally, the present invention is directed to electromechanical contactors, and more particularly, exemplary embodiments of the present invention are directed to integrated planar electromechanical contactors with embedded wiring.

Conventionally, contactors are devices used to control the flow of current to/from electrical bus bars in a power distribution assembly. The contactors may be actuated by magnetic actuation, for example, by use of a wound coil solenoid. Due to the magnetic actuation, the contactors have relatively large form factors. Furthermore, individual contactors must be arranged on a backplane and interconnected through the use of a plurality of loose wiring for creation of power distribution assemblies. This results in a large number of wires and complicated assembly.

BRIEF DESCRIPTION OF THE INVENTION

According to one exemplary embodiment of the present invention, an integrated planar electromechanical contactor assembly includes a substrate, a through-hole formed through the substrate, a plurality of solenoid traces embedded within the substrate about the through-hole in a plurality of distinct planes, a solenoid core arranged in the through hole in electromagnetic communication with the plurality of solenoid traces, and a mobile contact arm. The plurality of distinct planes are substantially parallel to one another and each solenoid trace of the plurality of solenoid traces is in electrical communication with an adjacent solenoid trace through an electrical via. Furthermore, the mobile contact arm is configured to selectively connect an external contact lead arranged on the substrate to at least one electrical trace embedded within the substrate responsive to motion of the solenoid core.

According to another exemplary embodiment of the present invention, an integrated power distribution assembly includes a substrate, a plurality of electrical traces embedded within the substrate, and a plurality of electromechanical contactors integrated with the substrate. Each electromechanical contactor of the plurality of electromechanical contactors includes a through-hole formed through the substrate, a plurality of solenoid traces embedded within the substrate about the through-hole in a plurality of distinct planes, a solenoid core arranged in the through hole in electromagnetic communication with the plurality of solenoid traces, and a mobile contact arm. The plurality of distinct planes are substantially parallel to one another and each solenoid trace of the plurality of solenoid traces is in electrical communication with an adjacent solenoid trace through an electrical via. Furthermore, the mobile contact arm is configured to selectively connect an external contact lead arranged on the substrate to at least one electrical trace embedded within the substrate responsive to motion of the solenoid core.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Exemplary embodiments of the present invention provide integrated planar electromechanical contactors which reduce the complexity and number of loose wire in power distribution assemblies. Exemplary embodiments further provide embedded power distribution busses which further reduce loose wiring and simplify power distribution assemblies. The technical effects and benefits of the invention include reduced cost, complexity, and initial troubleshooting of power distribution assemblies.

Figure 1:
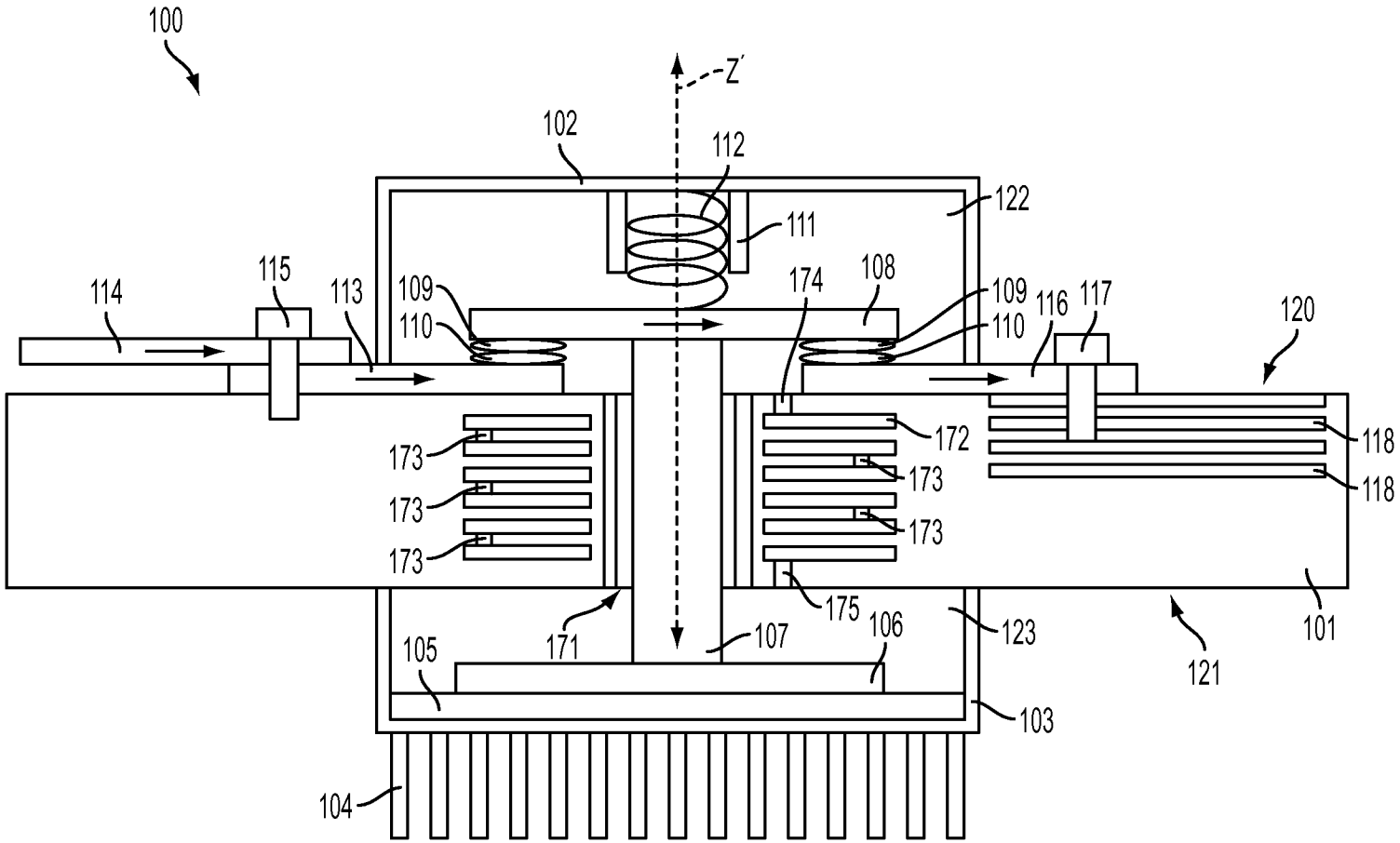
FIG. 1 is a side cut-away view of an integrated planar electromechanical contactor, according to an exemplary embodiment of the present invention.

Turning to FIG. 1, a side cut-away view of an integrated planar electromechanical contactor assembly is illustrated, according to an exemplary embodiment of the present invention. The contactor assembly 100 includes a first housing 102 arranged on a first surface 120 of a substrate 101. The substrate 101 may be any suitable substrate, including a laminated substrate. According to at least one exemplary embodiment, the substrate 101 is a laminated printed wiring board substrate comprising a plurality of laminated layers of insulating material. The insulating material may include composite dielectric materials as well as any suitable insulating/dielectric material.

The first housing 102 may be formed of any desirable material, including metal, plastic, or other suitable material. The first housing 102 defines an inner cavity 122 disposed to house a plurality of electrical components.

The contactor assembly 100 further includes second housing 103 arranged on a second surface 121 of the substrate 101. The second surface 121 may be substantially parallel to the first surface 120. Furthermore, the second housing 103 may define a second inner cavity 123 disposed to house a plurality of electrical components.

The contactor assembly 100 further includes a heat sink 104 arranged on the second housing 103. The heat sink 104 may be configured to dissipate received heat to a surrounding environment. The heat sink 104 may include a plurality of passive heat displacement features including fins. The contactor assembly 100 further includes thermal interface 105 arranged within an inner surface of the second inner cavity 123 proximate the heat sink 104 such that the thermal interface 105 transfers heat to the heat sink 104. The thermal interface 105 may be a gap pad thermal interface, for example, including thermally conductive filler material.

Turning back to FIG. 1, the contactor assembly 100 further includes at least one spring guide 111 arranged on an inner surface of the first inner cavity 122. The spring guide 111 may be substantially cylindrical, and may be configured to guide spring 112 in generally linear compression/decompression along axis Z'. The spring 112 may be any desirable spring or biasing agent, for example, a coil spring, elastomeric formation, or any other formation configured to provide force generally along the axis Z'.

The contactor assembly 100 further includes contact leads 113 and 116 arranged on the substrate 101. The contact leads 113 and 116 may be electrically conductive leads affixed to the substrate 101, for example with adhesive or through thermal application. Each of the thermal leads 113 and 116 may include stationary contacts 110 arranged thereon. The stationary contacts 110 may be any suitable contacts configured to contact mobile contacts 109. The mobile contacts 109 may be substantially similar to stationary contacts 110, and may be arranged on mobile contact arm 108. The mobile contact arm 108 may be an electrically conductive contact arm configured to move along the axis Z'. Therefore, the mobile contact arm 108 may both open and close electrical contact between contact leads 113 and 116. Additionally, an external bus bar 114 may be in electrical communication with contact lead 113 through conductive fastener 115. Therefore, external electrical energy may be transmitted across contact leads 113 and 116.

Figure 2:
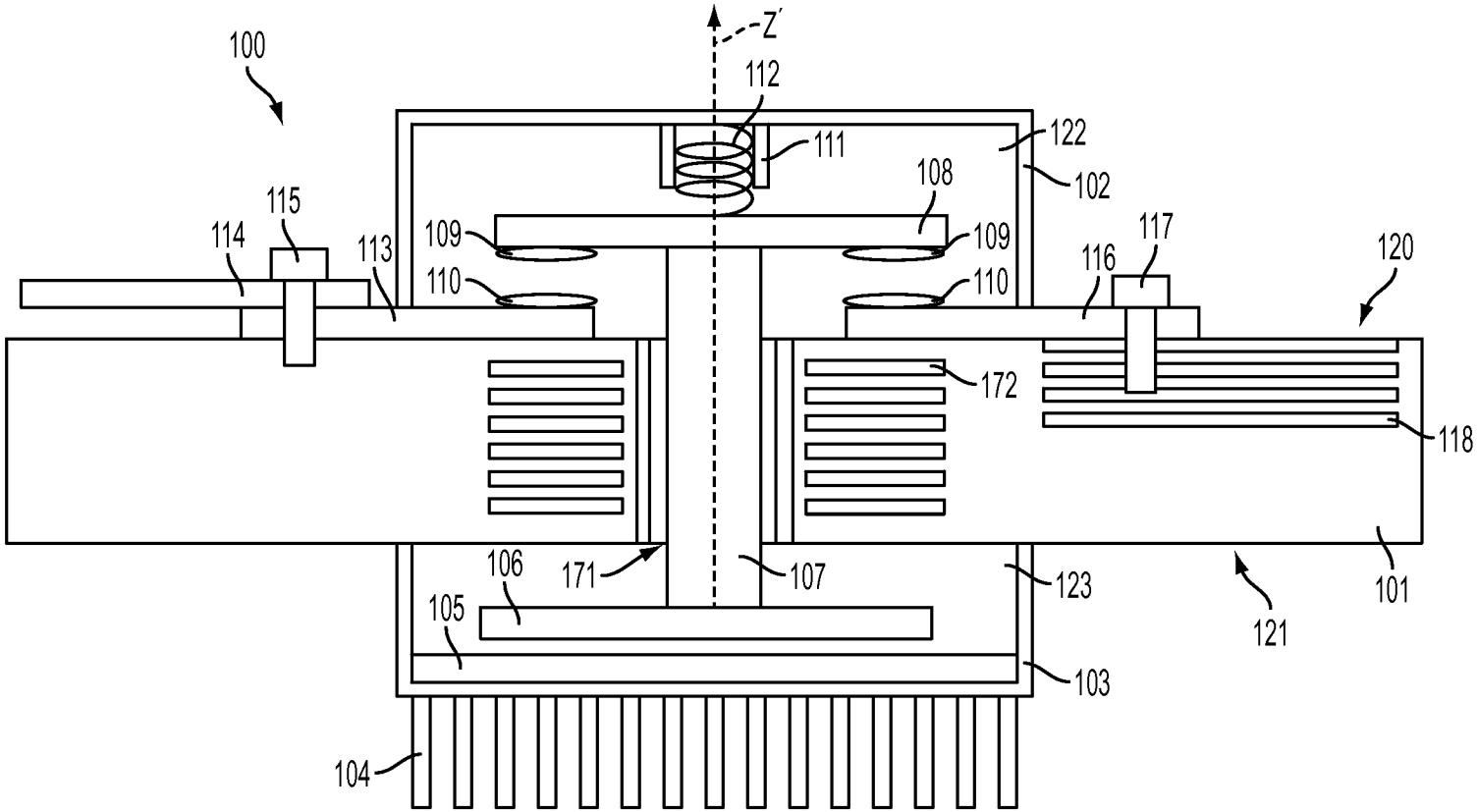
FIG. 2 is a side cut-away view of the contactor of FIG. 1 in an open configuration.

As shown, the mobile contact arm 108 is arranged on solenoid core 107. The solenoid core 107 may be a generally cylindrical ferromagnetic core. The solenoid core 107 may also be arranged within a through-hole 171. The through-hole 107 may be formed through the substrate 101 along the axis Z'. The through-hole 171 may be a generally cylindrical through-hole with a cross section complementary to that of the solenoid core 107. Therefore, the solenoid core 107 may travel within the through-hole 171 along the axis Z'. In this manner, the solenoid core 107 may guide the linear motion of the mobile contact arm 108. Furthermore, the contactor assembly 100 includes a heat spreader bar 106 arranged on the solenoid core 107. The heat spreader bar 106 is configured to selectively contact the thermal interface 105 during contactor operation such that heat generated at stationary contacts 110 and mobile contacts 109 is transmitted to the heat sink 104. As presently illustrated in FIG. 1, the contactor assembly 100 is arranged in the closed position, with electrical contact closed across contact leads 113 and 116. FIG. 2 is a side cut-away view of the contactor of FIG. 1 in an open configuration, with open contact between contact leads 113 and 116, and no contact between heat spread bar 106 and thermal interface 105.

Turning back to FIG. 1, the substrate 101 may include a plurality of electrical traces 118 embedded therein. The embedded electrical traces 118 may be configured to transmit electricity from the contact lead 116 to a plurality of loads (not illustrated for clarity). The embedded electrical traces 118 may be conductive traces formed of a conductive material laid between laminated layers of the substrate 101. For example, according to at least one exemplary embodiment, the embedded electrical traces 118 are copper traces etched onto laminated layers of the substrate 101.

Figure 3:
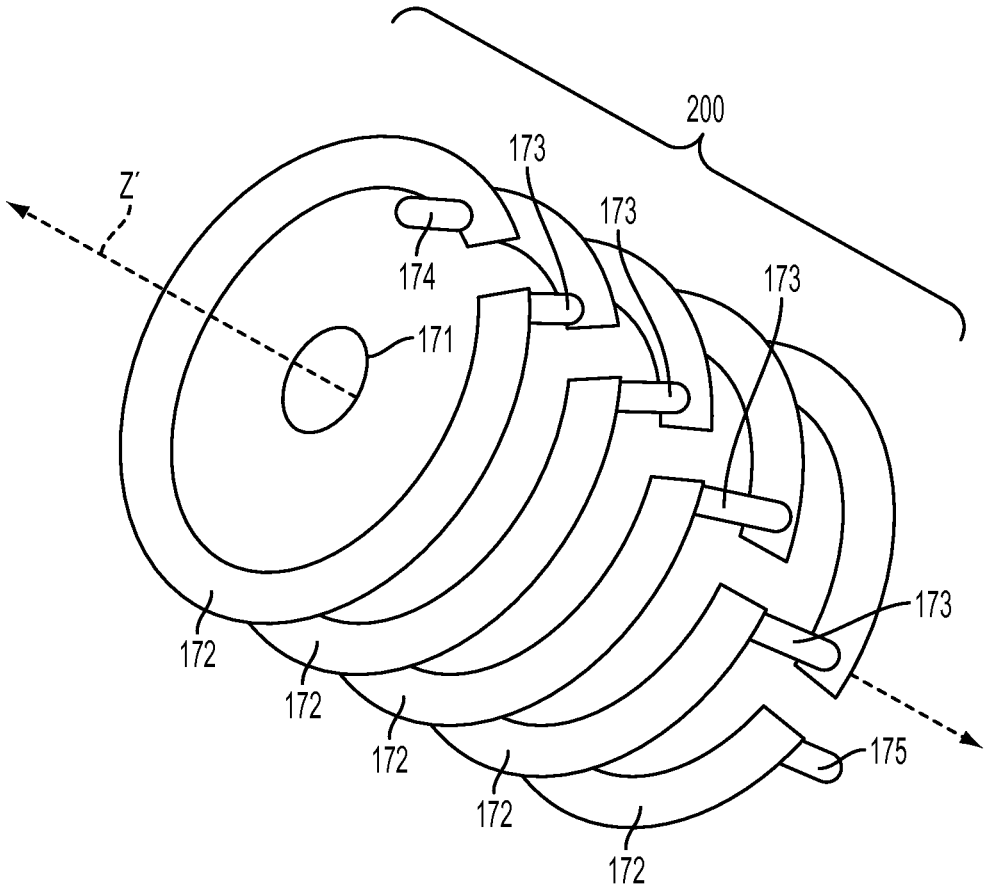
FIG. 3 is an exploded isometric view of a plurality of solenoid traces of the contactor of FIG. 1.

Similarly, the substrate 101 may include a plurality of solenoid traces 172 embedded therein. Such is more clearly illustrated in the exploded isometric view of FIG. 3. As shown, each solenoid trace of the plurality of solenoid traces 172 may be a generally circular or rectangular conductive trace surrounding the through-hole 171. Each solenoid trace of the plurality of solenoid traces 172 may be arranged in distinct planes (e.g., laminations of the substrate 101) parallel to one another and substantially parallel to the first surface 120 and/or the second surface 121; and/or substantially orthogonal to the axis Z'. Furthermore, each solenoid trace of the plurality of solenoid traces may be in electrical communication with one or more adjacent proximate solenoid traces through one or more vias 173 such that a substantially helical conductive formation 200 arranged about the through-hole 171 is realized. As such, application of an electrical potential at opposite ends of the plurality of solenoid traces 172 may induce a magnetic field within the plurality of solenoid traces 172 configured to actuate the contactor assembly 100 through motion of the solenoid core 107 along the axis Z'. Therefore, the solenoid core 107 is in electromagnetic communication with the plurality of solenoid traces 172. Application of the electric potential is facilitated by conductive via 174 arranged proximate the first surface 120 and conductive via 175 arranged proximate the second surface 121 (see FIGS. 1 and 3).

It should be understood that the particular placement of the vias 173, 174, and 175 may be altered according to any desired implementation of exemplary embodiments, and therefore, the illustrated placements should be construed merely as functional examples.

Furthermore, although illustrated and described as having a single set of contacts 109-110, the same may be extended such that a plurality of phases of electricity may be routed, for example, through inclusion of more contacts on the mobile contact arm 108 and respective conductive leads. Therefore, the contactor assembly 100 may be extended to any desired number of contacts, and as such, may interrupt any desired number of electrical phases, for example, three phases.

Figure 4:
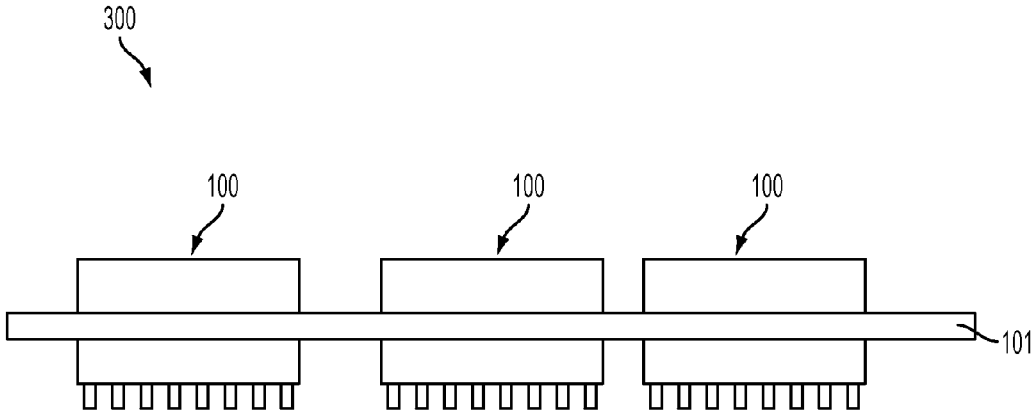
FIG. 4 is a side-view of a power distribution assembly, according to an exemplary embodiment of the present invention.
Figure 5:
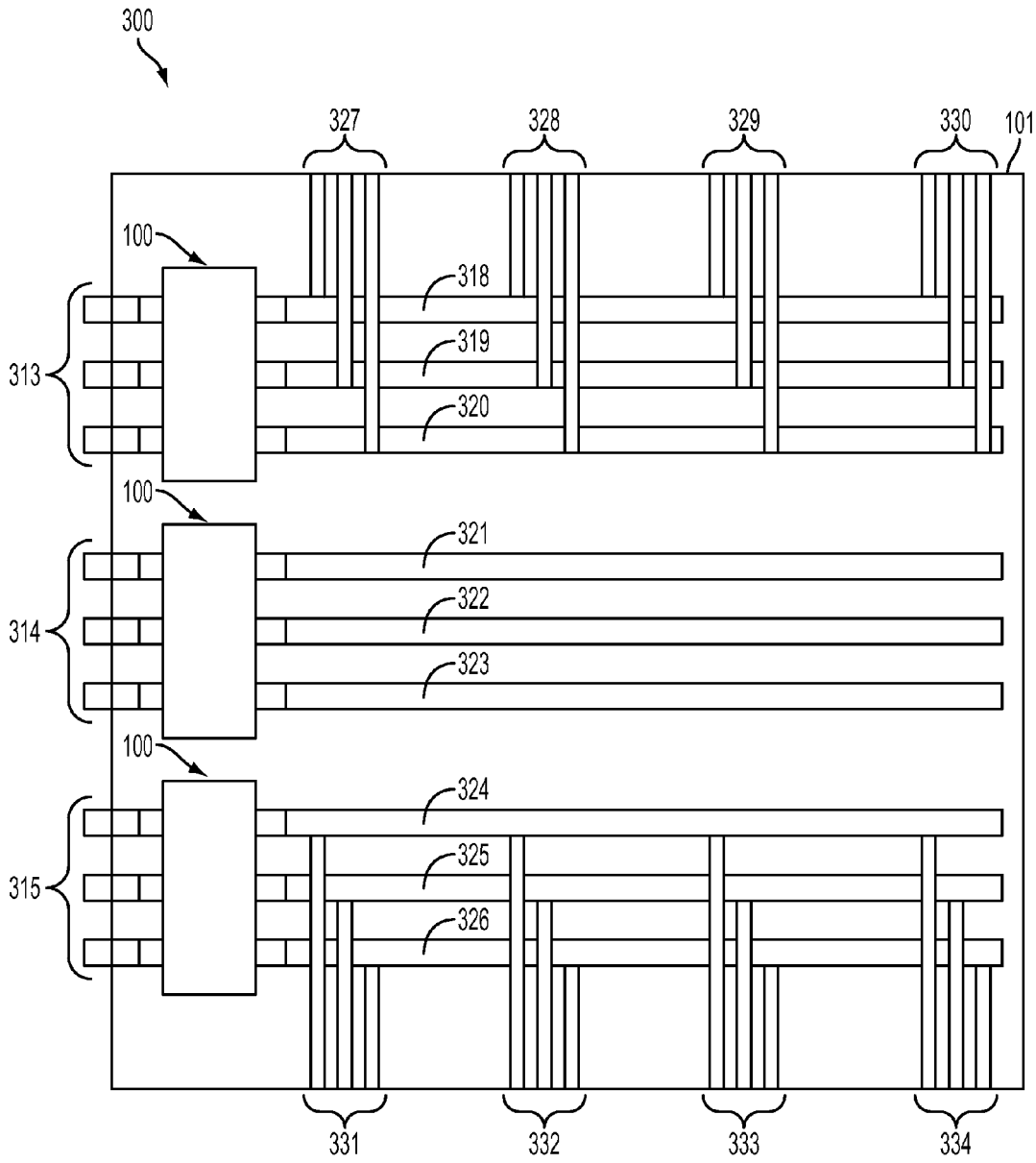
FIG. 5 is an overhead-view of the power distribution assembly of FIG. 4.

As described above, electromechanical contactors 101 may be integrated with a substrate 101 such that integrated planar electromechanical devices are formed. Furthermore, embedded electrical traces (e.g., 118) may be used to direct electrical energy from a contactor. Turning now to FIGS. 4 and 5, a power distribution assembly with integrated planar electromechanical contactors is illustrated.

FIG. 4 is a side-view of a power distribution assembly 300, according to an exemplary embodiment of the present invention. As shown, a plurality of individual contactors 100 may be integrated with substrate 101. Furthermore, as illustrated in FIG. 5, each contactor 100 may be in electrical communication with respective external electrical buses 313, 314, and 315. For example, each bus of the electrical buses 313, 314, and 315 may be substantially similar to bus 114 of FIG. 1. Furthermore, the substrate 101 may include a plurality of embedded electrical traces 318, 319, 320, 321, 322, 323, 324, and 326 embedded therein. The plurality of embedded electrical traces 318, 319, 320, 321, 322, 323, 324, and 326 may be arranged to route electrical power from buses 313, 314, and 315 upon control through the plurality of contactors 100. Furthermore, individual loads in a plurality of different physical locations may be integrated with the embedded electrical traces 318, 319, 320, 321, 322, 323, 324, and 326 through use of secondary electrical traces 327, 328, 329, 330, 331, 332, 333, and 334 embedded within the substrate 101. As such, a fully distributed power assembly may be realized with reduces loose wires and integrated contactor controls through conductive vias and traces.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An integrated planar electromechanical contactor assembly, comprising:

a substrate having a through-hole formed through it;

a plurality of solenoid traces embedded within the substrate about the through-hole in a plurality of distinct planes, wherein the plurality of distinct planes are substantially parallel to one another, and wherein each solenoid trace of the plurality of solenoid traces is in electrical communication with an adjacent solenoid trace through an electrical via;

a solenoid core arranged in the through hole in electromagnetic communication with the plurality of solenoid traces; and a mobile contact arm arranged on the solenoid core, wherein the mobile contact arm is configured to selectively connect an external contact lead arranged on the substrate to at least one electrical trace embedded within the substrate responsive to motion of the solenoid core;

wherein the through-hole defines an axis substantially perpendicular to a plane formed by the substrate, and wherein the solenoid core is configured to travel along the axis.

2. The assembly of claim 1, wherein the plurality of solenoid traces form a helical conductive formation about the through-hole within the substrate.

3. The assembly of claim 1, further comprising:

a heat spreader bar arranged on the solenoid core distally from the mobile contact arm configured to receive heat from the mobile contact arm.

4. The assembly of claim 3, further comprising:

a housing arranged on a surface of the substrate, wherein the housing defines an inner cavity disposed to house electrical components; and a thermal interface arranged on a surface of the inner cavity, wherein the heat spreader bar is configured to selectively engage the thermal interface responsive to linear motion of the solenoid core.

5. The assembly of claim 1, further comprising:

a housing arranged on the substrate, wherein the housing defines an inner cavity disposed to house electrical components; and a biasing element arranged on a surface of the inner cavity, wherein the biasing element is disposed to bias linear motion of the mobile contact arm.

6. The assembly of claim 1, further comprising:

a second contact lead arranged on the substrate in electrical communication with the at least one electrical trace, wherein the mobile contact arm is configured to selectively connect the external contact lead and the second contact lead responsive to motion of the solenoid core.

7. The assembly of claim 6, further comprising a conductive fastener arranged between the second contact lead and the at least one electrical trace.

8. The assembly of claim 1, wherein the substrate comprises a plurality of distinct laminations, and wherein each solenoid trace of the plurality of solenoid traces is embedded between different laminations.

9. The assembly of claim 1, wherein the substrate comprises a plurality of distinct laminations, and wherein the at least one electrical trace is embedded between laminations.

10. The assembly of claim 1, further comprising:

a plurality of external contact leads arranged on the substrate; and a plurality of embedded electrical traces embedded within the substrate, wherein the mobile contact arm is configured to selectively connect the plurality of external contact leads to respective embedded electrical traces of the plurality of embedded electrical traces responsive to motion of the solenoid core.

11. The assembly of claim 1, wherein the axis is substantially orthogonal to each solenoid trace of the plurality of solenoid traces.

12. The assembly of claim 1, wherein the mobile contact arm is configured to travel along the axis responsive to linear motion of the solenoid core along the axis.

13. An integrated power distribution assembly, comprising:

a substrate having a plurality of through-holes formed through it;

a plurality of electrical traces embedded within the substrate; and a plurality of electromechanical contactors integrated with the substrate, wherein each electromechanical contactor of the plurality of electromechanical contactors is associated with one of the plurality of through-holes and comprises:

a plurality of solenoid traces embedded within the substrate the through-hole associated with the contactor in a plurality of distinct planes, wherein the plurality of distinct planes are substantially parallel to one another, and wherein each solenoid trace of the plurality of solenoid traces is in electrical communication with an adjacent solenoid trace through an electrical via, and wherein each respective plurality of solenoid traces form a helical conductive formation about an associated through-hole within the substrate;

a solenoid core arranged in the through-hole associated with the contactor in electromagnetic communication with the plurality of solenoid traces;

a mobile contact arm arranged on the solenoid core, wherein the mobile contact arm is configured to selectively connect an external contact lead arranged on the substrate to at least one electrical trace of the plurality of electrical traces embedded within the substrate responsive to motion of the solenoid core; and a heat spreader bar arranged on the solenoid core distally from the mobile contact arm configured to receive heat from the mobile contact arm.

14. The assembly of claim 13, wherein each electromechanical contactor further comprises:

a housing arranged on a surface of the substrate, wherein the housing defines an inner cavity disposed to house electrical components; and a thermal interface arranged on a surface of the inner cavity, wherein the heat spreader bar is configured to selectively engage the thermal interface responsive to linear motion of the solenoid core.

15. The assembly of claim 13, wherein each electromechanical contactor further comprises:

a housing arranged on the substrate, wherein the housing defines an inner cavity disposed to house electrical components; and a biasing element arranged on a surface of the inner cavity, wherein the biasing element is disposed to bias linear motion of the mobile contact arm.

16. The assembly of claim 13, wherein each electromechanical contactor further comprises:

a second contact lead arranged on the substrate in electrical communication with the at least one electrical trace, wherein the mobile contact arm is configured to selectively connect the external contact lead and the second contact lead responsive to motion of the solenoid core.

17. The assembly of claim 13, wherein the substrate further comprises a plurality of distinct laminations, and wherein each solenoid trace of the plurality of solenoid traces is embedded between different laminations.

* * * * *